US010518789B2

(12) United States Patent
Zhao et al.

(10) Patent No.: US 10,518,789 B2
(45) Date of Patent: Dec. 31, 2019

(54) COUPLING ASSEMBLY AND RAIL VEHICLE HAVING SAME

(71) Applicant: CRRC QINGDAO SIFANG CO., LTD., Qingdao, Shandong (CN)

(72) Inventors: Shizhong Zhao, Shandong (CN); Yonggui Zhang, Shandong (CN); Aiqin Tian, Shandong (CN); Sansan Ding, Shandong (CN); Guidong Tao, Shandong (CN); Quanwei Che, Shandong (CN); Yangyang Yu, Shandong (CN)

(73) Assignee: CRRC QINGDAO SIFANG CO., LTD., Qingdao, Shandong (CN)

( * ) Notice: Subject to any disclaimer, the term of this patent is extended or adjusted under 35 U.S.C. 154(b) by 0 days.

(21) Appl. No.: 16/310,446

(22) PCT Filed: Sep. 29, 2017

(86) PCT No.: PCT/CN2017/104174

§ 371 (c)(1),
(2) Date: Dec. 16, 2018

(87) PCT Pub. No.: WO2018/072611

PCT Pub. Date: Apr. 26, 2018

(65) Prior Publication Data

US 2019/0329800 A1 Oct. 31, 2019

(30) Foreign Application Priority Data

Oct. 21, 2016 (CN) ..... 2016 1 0920379
Oct. 21, 2016 (CN) ..... 2016 1 0920536
Oct. 21, 2016 (CN) ..... 2016 1 0921273

(51) Int. Cl.
*B61G 7/08* (2006.01)
*B61G 3/16* (2006.01)
(Continued)

(52) U.S. Cl.
CPC ..... *B61G 7/08* (2013.01); *B61G 3/16* (2013.01); *B61G 7/10* (2013.01); *B61G 7/12* (2013.01);
(Continued)

(58) Field of Classification Search
CPC ... B61G 3/16; B61G 7/08; B61G 7/10; B61G 7/12; B61G 9/20; B61G 9/22; B61G 9/24
(Continued)

(56) References Cited

U.S. PATENT DOCUMENTS 2,885,093 A * 5/1959 Williams ..... B61G 7/10 213/21
2,894,646 A * 7/1959 Hicks ..... B61G 7/10 213/21
(Continued)

FOREIGN PATENT DOCUMENTS

AU 2009324267 A1 8/2010
CN 2428380 Y 5/2001
(Continued)

OTHER PUBLICATIONS

International Search Report for PCT/CN2017/104174 dated Jan. 3, 2018, ISA/CN.
(Continued)

*Primary Examiner* — Zachary L Kuhfuss
(74) *Attorney, Agent, or Firm* — Yue(Robert) Xu; Apex Attorneys at Law, LLP

(57) ABSTRACT

A coupler assembly, arranged at a front end of a vehicle head of a rail vehicle, includes: a coupler mounting base fixed to the vehicle head; a coupler fixedly mounted to the coupler mounting base, and a supporting component provided at each of two sides of the coupler mounting base. The supporting component has a guiding slide way inclined longitudinally, a front end of the guiding slide way is higher
(Continued)

than a rear end of the guiding slide way; a sliding component is fixedly provided at each of the two sides of the coupler mounting base, and the sliding component slidably cooperates with the guiding slide way at a respective side; and the coupler assembly is configured such that in an initial state, the coupler mounting base is fixedly connected to the supporting component, and the sliding component is located at a front end of the guiding slide way.

20 Claims, 11 Drawing Sheets

(51) Int. Cl.

| | |
|---|---|
| ***B61G 7/12*** | (2006.01) |
| ***B61G 9/24*** | (2006.01) |
| ***B61G 7/10*** | (2006.01) |
| *B61G 1/18* | (2006.01) |
| *B61G 9/04* | (2006.01) |
| *B61G 9/20* | (2006.01) |
| *B61G 7/14* | (2006.01) |

(52) U.S. Cl.
CPC ..... *B61G 9/24* (2013.01); *B61G 1/18* (2013.01); *B61G 7/14* (2013.01); *B61G 9/04* (2013.01); *B61G 9/20* (2013.01)

(58) Field of Classification Search
USPC ..... 213/4, 61, 62 A, 72
See application file for complete search history.

(56) References Cited

U.S. PATENT DOCUMENTS

| | | | | | |
|---|---|---|---|---|---|
| 3,119,500 | A | | 1/1964 | Zanow | |
| 3,556,312 | A | * | 1/1971 | Herbert | B61G 7/00 213/14 |
| 3,910,418 | A | | 10/1975 | Hawthorne | |
| 3,987,907 | A | * | 10/1976 | Larsen | B61G 7/12 213/61 |
| 4,032,017 | A | * | 6/1977 | Larsen | B61G 7/12 213/61 |
| 4,059,192 | A | * | 11/1977 | Larsen | B61G 9/22 213/61 |
| 4,445,617 | A | | 5/1984 | Elliott | |
| 4,576,294 | A | * | 3/1986 | Forster | B61G 3/16 213/1 A |
| 4,703,862 | A | * | 11/1987 | Werner | B61G 5/08 213/76 |
| 5,355,971 | A | | 10/1994 | Austin et al. | |
| 5,472,104 | A | * | 12/1995 | Domsgen | B61G 7/08 213/18 |
| 8,091,717 | B2 | * | 1/2012 | Sprave | B61G 7/12 213/18 |
| 8,960,464 | B2 | * | 2/2015 | Peckham | B61G 9/24 213/9 |
| 2008/0277366 | A1 | | 11/2008 | Kemper | |
| 2010/0326944 | A1 | | 12/2010 | Gaiguant et al. | |
| 2012/0267333 | A1 | | 10/2012 | Bomgardner et al. | |
| 2012/0298609 | A1 | | 11/2012 | Yoshida et al. | |
| 2015/0069002 | A1 | | 3/2015 | Stroud | |
| 2015/0251671 | A1 | | 9/2015 | Iler | |

FOREIGN PATENT DOCUMENTS

| | | | | | |
|---|---|---|---|---|---|
| CN | 201143951 | Y | | 11/2008 | |
| CN | 101475012 | A | | 7/2009 | |
| CN | 101898563 | A | | 12/2010 | |
| CN | 201825053 | U | | 5/2011 | |
| CN | 102438873 | A | | 5/2012 | |
| CN | 103332204 | A | | 10/2013 | |
| CN | 103625502 | A | | 3/2014 | |
| CN | 104494630 | A | | 4/2015 | |
| CN | 104512432 | A | | 4/2015 | |
| CN | 105083317 | A | | 11/2015 | |
| CN | 105151075 | A | | 12/2015 | |
| CN | 103889815 | B | | 5/2016 | |
| CN | 105966417 | A | | 9/2016 | |
| CN | 106364522 | A | | 2/2017 | |
| CN | 106379368 | A | | 2/2017 | |
| CN | 106494451 | A | | 3/2017 | |
| EP | 0608531 | A1 | | 8/1994 | |
| FR | 2850930 | A1 | * | 8/2004 | B61D 15/06 |
| GB | 1375009 | A | | 11/1974 | |
| JP | 2007216719 | A | | 8/2007 | |
| JP | 2010260433 | A | | 11/2010 | |

OTHER PUBLICATIONS

SIPO First Office Action corresponding to Application No. 201610921273.9; dated Jan. 4, 2018.
SIPO First Office Action corresponding to Application No. 201610920379.7; dated Feb. 1, 2018.
SIPO First Office Action corresponding to Application No. 201610920536.4; dated Feb. 24, 2018.
The GB Examination Report dated Feb. 18, 2019.

* cited by examiner

COUPLING ASSEMBLY AND RAIL VEHICLE HAVING SAME

This application is the national phase of International Application No. PCT/CN2017/104174, titled "COUPLING ASSEMBLY AND RAIL VEHICLE HAVING SAME", filed on Sep. 29, 2017, which claims the benefit of priorities to Chinese Patent Applications No. 201610920536.4, No. 201610921273.9, No. 201610920379.7, all titled "COUPLER ASSEMBLY AND RAIL VEHICLE HAVING THE SAME" and filed with the Chinese State Intellectual Property Office on Oct. 21, 2016, the entire disclosures of which are incorporated herein by reference.

FIELD

The present application relates to the technical field of rail vehicles, and more particularly to a coupler assembly and a rail vehicle having the coupler assembly.

BACKGROUND

With the increase of the traveling speed of high-speed trains, passive safety receives more and more attentions.

For reducing the air resistance and improving the starting performance, currently, head portions of trains are generally designed to have a streamlined shuttle shape. With this design, although the train may have a reduced traveling resistance and an increased speed, a front end portion of its head portion may have a narrow space, and can only accommodate a coupler assembly, and has no space for accommodating a large-scale energy-absorbing mechanism.

When two high-speed trains collide, the coupler assemblies are the members which are subjected to the shock first. Although a coupler can be configured as an energy-absorbing coupler, it can only absorb limited amount of energy, and cannot fully absorb the energy generated by the collision of trains. Thus, there is a hidden danger that in the retreating process after the coupler is collided, the coupler may intrude an upper part of the train head to damage the devices in the upper part or may fall onto a rail to increase the risk of derailment.

Therefore, the technical issue to be addressed by the person skilled in the art is to improve the structure of the conventional coupler, to fully ensure that an energy absorbing module of the rear end of the coupler can exert its function, to prevent the problems that in the retreating process after the coupler is collided, the coupler may intrude the upper part of the train head to damage the devices in the upper part or may fall onto the rail to increase the risk of derailment.

SUMMARY

A coupler assembly and a rail vehicle having the coupler assembly are provided according to the present application. The structural design of the coupler assembly can not only ensure a coupling function of a coupler in normal operation of the vehicle, but also can prevent the problems that in the retreating process after the coupler is collided, the coupler may intrude an upper part of a vehicle head to damage devices in the upper part or may fall onto a rail to increase the risk of derailment, thereby improving the passive safety of the rail vehicle in collision.

In order to address the above technical issues, a coupler assembly is provided according to the present application, which is configured to be arranged at a front end of a vehicle head of a rail vehicle, and the coupler assembly includes:

a coupler mounting base fixed to the vehicle head; and a coupler fixedly mounted to the coupler mounting base, and the coupler assembly further includes: a supporting component provided at each of two sides of the coupler mounting base, the supporting component has a guiding slide way inclined longitudinally, and a front end of the guiding slide way is higher than a rear end of the guiding slide way; and a sliding component is fixedly provided at each of the two sides of the coupler mounting base, and the sliding component slidably cooperates with the guiding slide way at a respective side; and the coupler assembly is configured such that in an initial state, the coupler mounting base is fixedly connected to the supporting component, and the sliding component is located at a front end of the guiding slide way.

In the coupler assembly according to the present application, its coupler mounting base is fixedly connected to the vehicle head, and the supporting components having the guiding slide ways are provided at the two sides of the coupler mounting base respectively, and the sliding components slidably cooperating with the guiding slide ways respectively are fixedly provided on the coupler mounting base. Each of the guiding slide ways is inclined in the longitudinal direction of the vehicle body, and has a front end higher than a rear end thereof. In practice, when the rail vehicle collides, a fixed state between the coupler mounting base, to which the coupler is fixed, and the supporting components is released. At this time, since the sliding components of the coupler mounting base can be slidably cooperated with the guiding slide ways respectively, the coupler mounting base may slide together with the sliding components along the guiding slide ways towards the rear lower side of the vehicle body, that is, the motion path of the coupler mounting base after being collided is limited, thus preventing the coupler mounting base from intruding into an upper part and damaging the equipment in the upper part accordingly or falling onto the rail and increasing the risk of derailment accordingly, and thereby in turn improving the passive safety of the rail vehicle in collision. It is to be noted that the couplers of two vehicles are coupled during the collision, therefore, the coupler and the coupler mounting base can be kept in a horizontal state while sliding along the guiding slide ways.

The supporting component is a plate body fixed to a bottom of a traction beam of the vehicle head.

The coupler assembly further includes a stop plate fixed to the traction beam, and the stop plate is located above the coupler mounting base.

The guiding slide way is a slide hole formed in the plate body, and the sliding component is a pin; or, the guiding slide way is a slide slot formed in the plate body, and the sliding component is a pulley.

The guiding slide way is a guiding slide slot formed in the supporting component, and the sliding component is a sliding block.

Another coupler assembly is further provided according to the present application, which is configured to be arranged at a front end of a vehicle head of a rail vehicle, and the coupler assembly includes:

a coupler mounting base fixed to the vehicle head; and a coupler fixedly mounted to the coupler mounting base, wherein the coupler assembly further includes a supporting component and a rotating member both provided at each of two sides of the coupler mounting base;

the rotating member has one end rotatably connected to a lower end of the respective supporting component, a rotation center of this end is arranged horizontally and perpendicular to a length direction of the rail vehicle, and the rotating member has another end hinged to an upper end of the coupler mounting base; and the coupler assembly is configured such that in an initial state, the coupler mounting base is fixedly connected to the supporting component, and a hinge point where the rotating member is hinged to the coupler mounting base is located above a rotational connection point where the rotating member is rotatably connected to the respective supporting component.

In the coupler assembly according to the present application, each of two sides of the coupler mounting base is provided with the supporting component and the rotating member, and the rotating member has one end rotatably connected to a lower end of the respective supporting component and another end hinged to an upper end of the coupler mounting base, and the coupler assembly is configured such that in an initial state, the coupler mounting base is fixedly connected to the supporting components, and the connection point where the rotating member is connected to the coupler mounting base is higher than the connection point where the rotating member is connected to the respective supporting component. In practice, after the rail vehicle collides, the coupler mounting base, to which the coupler is fixedly mounted, is collided to be broken, the fixing state between the coupler mounting base and the supporting components is released, and at this time, since the rotating members are rotatably connected to the lower ends of the supporting components, the rotating members rotate towards the rear side of the vehicle body due to the effect of the collision, and since the coupler mounting base is hinged to the rotating members, the coupler and the coupler mounting base can be driven by the rotation of the rotating members to move along a circular-arc path to the rear lower side of the vehicle body. That is, the motion path of the coupler mounting base after being collided is limited, thus preventing the coupler mounting base from intruding an upper part above the supporting components and damaging the equipment in the upper part accordingly or falling onto the rail and increasing the risk of derailment accordingly, and thereby in turn improving the passive safety of the rail vehicle in collision. It is to be noted here that the couplers of two vehicles are coupled during the collision, therefore, the coupler driven by the rotation of the rotating members can be kept in a horizontal state all along.

It is to be noted that, this coupler assembly has the same principle as the coupler assembly described above, namely, the motion path of the coupler mounting base after being collided is limited by providing related components. Specifically, the motion path of the coupler mounting base after being collided is towards a rear lower side of the vehicle body.

The rotating member is hinged to the coupler mounting base by a first rotating shaft, and the rotating member is rotatably connected to the respective supporting component by a second rotating shaft.

The first rotating shaft and the second rotating shaft are respectively fixed to the coupler mounting base and the respective supporting component by fasteners.

The coupler assembly further includes a mounting plate configured to be connected to the vehicle head. The mounting plate is fixedly connected to rear ends of two of the supporting components.

The supporting component is an extrudate structure.

The coupler is a coupler having an energy absorbing structure.

A rail vehicle is further provided according to the present application, which includes a vehicle head and a coupler assembly provided at a front end of the vehicle head. The coupler assembly is the coupler assembly according to any one of the above aspects.

Since the above coupler assembly has the above technical effects, the rail vehicle having the coupler assembly also has the corresponding technical effects, which will not be repeated here.

Figure 1:
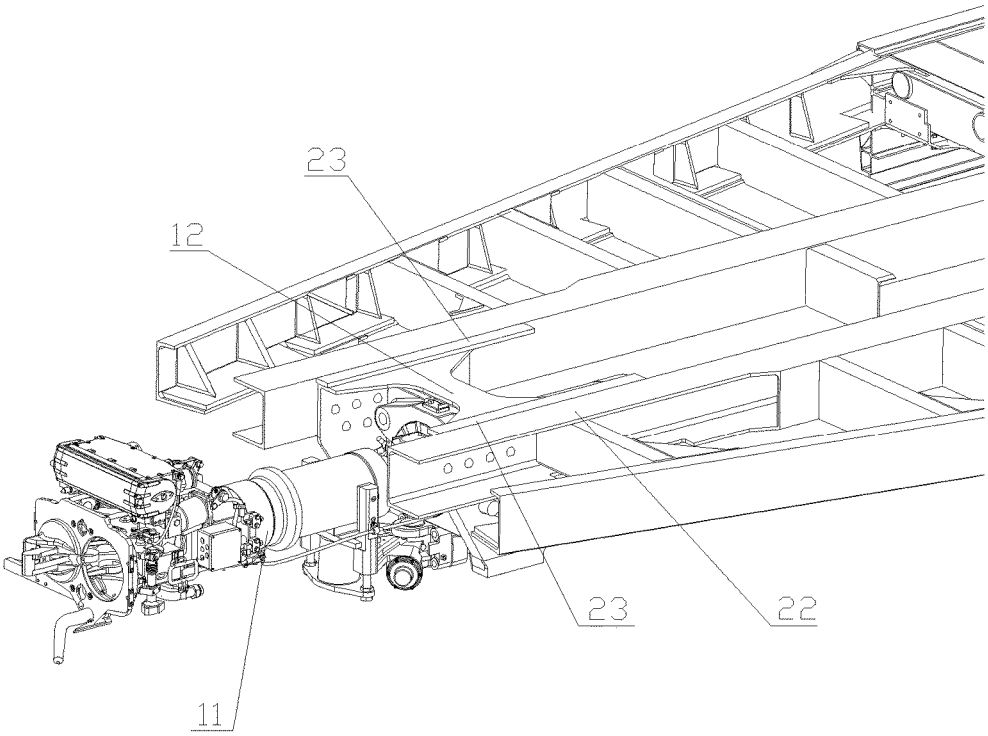
FIG. 1 is a schematic view showing the structure of a first embodiment of a coupler assembly according to the present application.

One-to-one correspondences among names and reference numerals of components in FIGS. 1 to 17 are as follows:

| | | | |
|---|---|---|---|
| 11 | coupler, | 12 | coupler mounting base, |
| 121 | sliding component, | 121a | pin, |
| 121b | sliding block; | 21 | supporting component, |
| 21a | plate body, | 211 | guiding slide way, |
| 211a | slide hole, | 211b | guiding slide slot, |
| 22 | traction beam, | 23 | stop plate, |
| 24 | mounting plate, | 25 | rotating member. |

DETAILED DESCRIPTION

For making the person skilled in the art better understand the technical solutions of the present application, the present application is further described in detail hereinafter with reference to the drawings and embodiments.

A front end of a vehicle head of a rail vehicle is equipped with a coupler assembly, and an equipment compartment is located at a rear side of the coupler assembly. It is to be noted that the locality term "front" herein refers to an end close to the vehicle head, and correspondingly, the locality term "rear" refers to an end away from the vehicle head.

Figure 2:
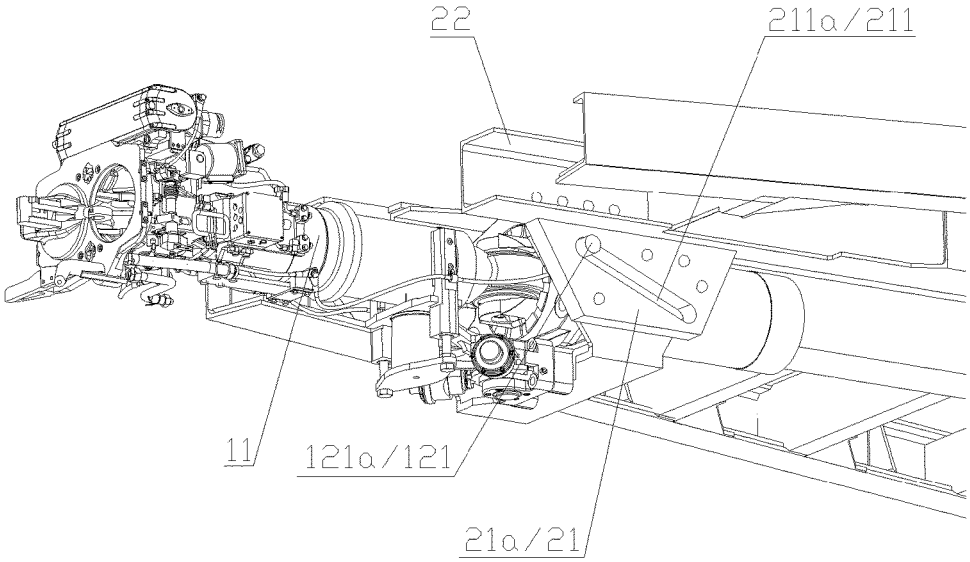
FIG. 2 is a schematic view showing the structure of the coupler assembly in FIG. 1 viewed from another angle.
Figure 3:
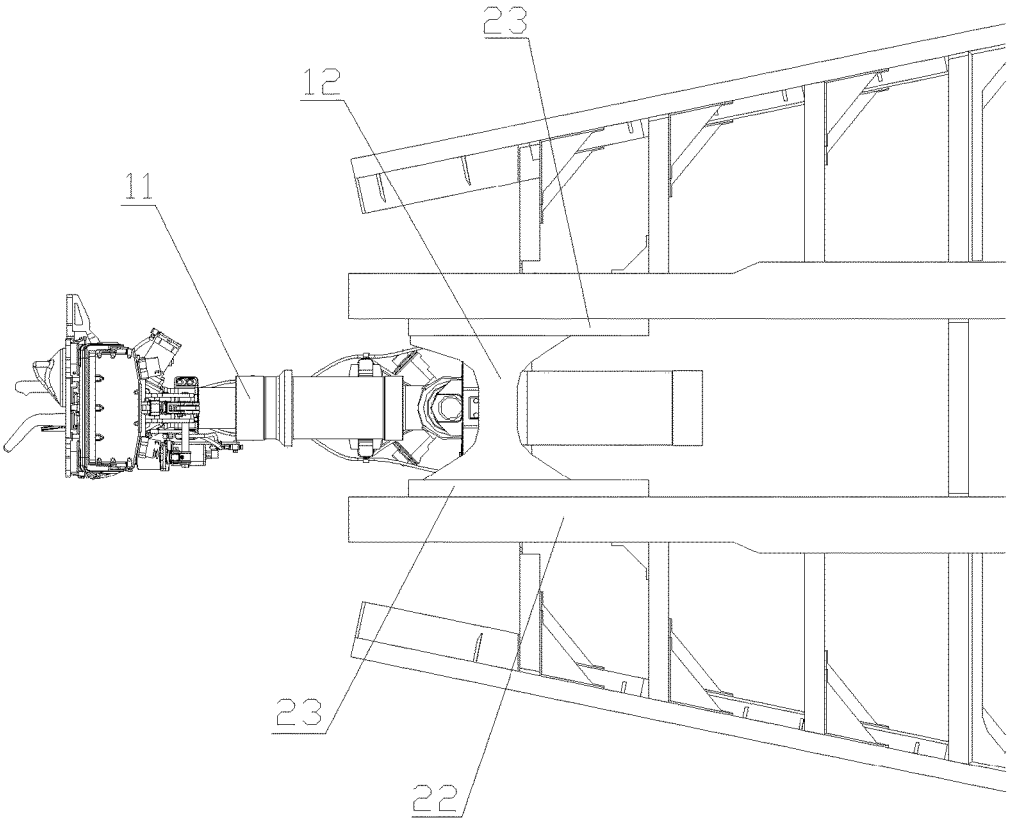
FIG. 3 is a top view of the coupler assembly in FIG. 1.

Referring to FIGS. 1 to 3, FIG. 1 is a schematic view showing the structure of a first embodiment of the coupler assembly according to the present application; FIG. 2 is a schematic view showing the structure of the coupler assembly in FIG. 1 viewed from another angle; and FIG. 3 is a top view of the coupler assembly in FIG. 1.

In this embodiment, the coupler assembly includes a coupler 11 and a coupler mounting base 12. The coupler 11 is fixedly mounted to the coupler mounting base 12.

In this solution, the coupler mounting base 12 is fixed to traction beams 22 of the vehicle head.

In this embodiment, the coupler assembly further includes two supporting components 21 respectively located at two sides of the coupler mounting base 12. In this solution, the supporting components 21 are specifically embodied as plate bodies 21*a*, and each of the plate bodies 21*a* is provided with a guiding slide way 211.

It is to be noted that, the two sides of the coupler mounting base 12 herein refer to two sides in a transverse direction of the rail vehicle.

The plate body 21*a* may be fixed to the bottom of a respective traction beam 22.

The guiding slide way 211 of the plate body 21*a* is inclined in a longitudinal direction and has a front end higher than a rear end thereof, that is, the guiding slide way 211 is arranged to be inclined towards a rear lower side of a vehicle body. The longitudinal direction here refers to a length direction of the rail vehicle.

A sliding component 121 is fixedly arranged at each of two sides of the coupler mounting base 12, and the sliding component 121 slidably cooperates with the guiding slide way 211 of the plate body 21*a* at the respective side.

The coupler assembly is specifically configured such that in an initial state, that is, after the coupler assembly and the vehicle head are initially assembled, the coupler mounting base 12 is fixedly connected to all the plate bodies 21*a*, and each of the sliding components 121 is located at a front end of the respective guiding slide way 211.

It is to be emphasized here that, the cooperation between the sliding component 121 and the guiding slide way 211 is specifically configured such that: when the relative fixed state among the coupler mounting base 12, the traction beams 22 and the plate bodies 21*a* is released, the sliding components 121 can drive the coupler mounting base 12 and the coupler 11 to slide together along the guiding slide ways 211 respectively.

As described above, the coupler mounting base 12 of the coupler assembly is fixedly connected to the traction beams 22, the plate bodies 21*a* having the guiding slide ways 211 are provided at the two sides of the coupler mounting base 12, and the sliding components 121 slidably cooperating with the guiding slide ways 211 respectively are fixedly arranged at the coupler mounting base 12, and specifically, each of the guiding slide ways 211 is inclined in the longitudinal direction of the vehicle body, and has a front end higher than a rear end thereof. In practice, when the rail vehicle collides, the fixed state among the coupler mounting base 12, to which the coupler 11 is fixed, the traction beams 22 and the plate bodies 21*a* is released, and since the sliding components 121 of the coupler mounting base 12 can slidably cooperate with the guiding slide ways 211 respectively, at this time the coupler mounting base 12 can slide together with the sliding components 121 along the guiding slide ways 211 towards the rear lower side of the vehicle body, that is, the motion path of the coupler mounting base 12 after being collided is limited, thereby preventing the coupler mounting base 12 from intruding an upper part above the traction beams 22 and damaging the devices in the upper part accordingly or from falling onto the rail and increasing the risk of derailment accordingly, and thereby in turn improving the passive safety of the rail vehicle in collision.

It is to be noted that the couplers 11 of two vehicles are coupled during the collision, therefore, the coupler 11 and the coupler mounting base 12 can be kept in a horizontal state while sliding along the guiding slide ways 211.

In an embodiment, the coupler assembly further includes a stop plate 23 which is fixed to the traction beam 22 and is located above the coupler mounting base 12, to limit the upward movement of the coupler mounting base 12. It may be appreciated that the stop plate 23 is not in contact with the coupler mounting base 12.

Specifically, the stop plate 23 may be provided at each of two sides above the coupler mounting base 12.

Specifically, the stop plate 23 may be fixed to the traction beam 22 in various ways, such as by welding, or by bolting.

In a solution, the guiding slide way 211 of the plate body 21*a* is a slide hole 211*a* formed in the plate body 21*a*, and the sliding component 121 fixed to the coupler mounting base 12 is configured as a pin 121*a*. In the specific configuration, a large end of the pin 121*a* is retained by the slide hole 211*a*, to prevent the pin 121*a* from disengaging from the slide hole 211*a* and meanwhile allow the pin 121*a* to slide along the slide hole 211*a*.

Of course, the sliding component 121 in cooperation with the slide hole 211*a* may also be other structures such as a screw.

In a solution, the guiding slide way 211 of the plate body 21*a* may also be a slide slot formed in the plate body 21*a*, and the sliding component 121 fixed to the coupler mounting base 12 may be configured as a pulley. In the specific configuration, the pulley is fitted in the slide slot, and can slide smoothly along the slide slot.

It can be appreciated that the guiding slide way 211 of the plate body 21*a* and the sliding component 121 in cooperation with the guiding slide way 211 are not limited to the two structures described above and may be configured as different structures as necessary as long as the sliding component 121 can drive the coupler mounting base 12 and the coupler 11 fixed to the coupler mounting base 12 to slide together along the guiding slide way 211.

In a solution, two ends of the coupler mounting base 12 are fixedly connected to the traction beams 22 and the plate bodies 21*a* by fasteners. More specifically, the fasteners may be rivets, bolts, cotter pins or the like. In this way, the coupler mounting base 12 fixedly connected to the traction beams 22 and the plate bodies 21*a* is detachable, thus facilitating the maintenance.

In a solution, the coupler 11 is configured as a coupler having an energy absorbing structure, in this way, when the rail vehicle is in collision, the coupler 11 can absorb the energy generated by the collision to a certain extent, thereby further improving the passive safety of the vehicle in collision.

Figure 4:
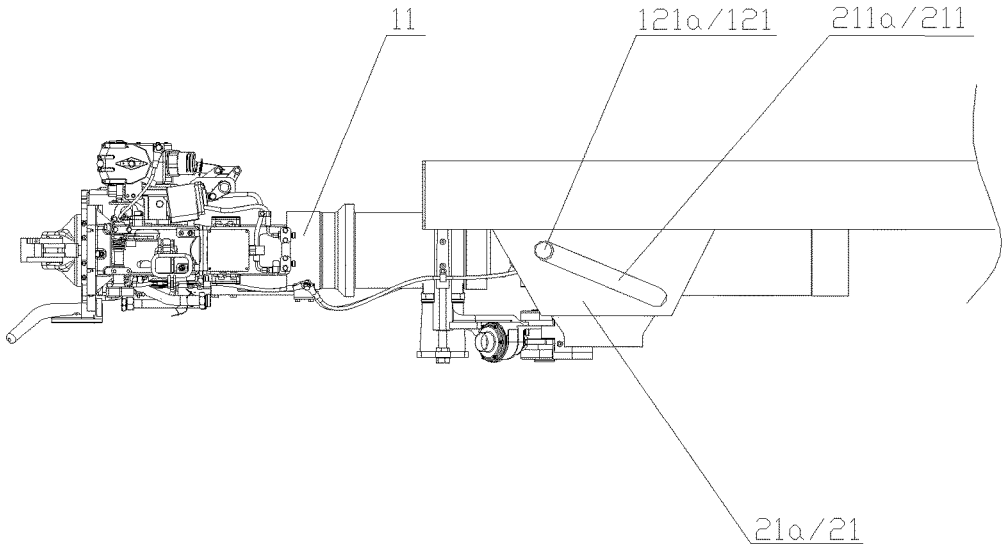
FIG. 4 is a schematic view showing the structure of the coupler assembly in FIG. 1 and a front end of a vehicle head before collision.
Figure 5:
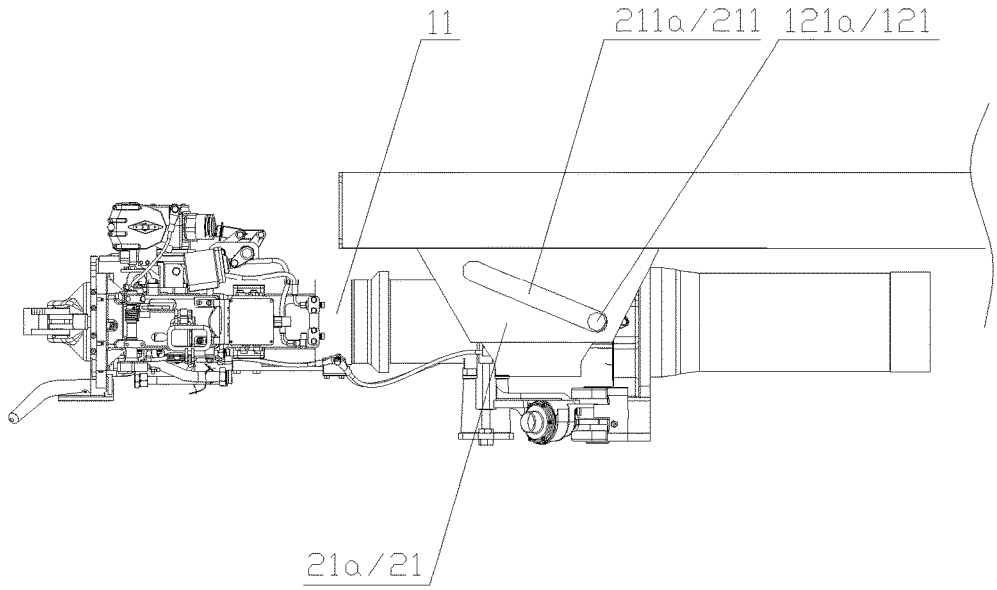
FIG. 5 is a schematic view showing the structure of the coupler assembly in FIG. 1 and the front end of the vehicle head after the collision.

Reference is made to FIGS. 4 and 5, FIG. 4 is a schematic view showing the structure of the coupler assembly in FIG.

1 and a front end of a vehicle head before collision; and FIG. 5 is a schematic view showing the structure of the coupler assembly in FIG. 1 and the front end of the vehicle head after the collision.

As shown in FIG. 4, in the initially assembled state, the coupler mounting base 12 and the plate bodies 21*a* of the coupler assembly are fixedly connected by fasteners, and at this time, each of the sliding components 121 fixed to the coupler mounting base 12 is located at a front end of the guiding slide way 211 of the respective plate body 21*a*.

When two rail vehicles collide, firstly, the couplers 11 of the two vehicles are coupled. Since the coupler 11 is an energy-absorbing coupler, its energy absorbing structure begins to perform primary energy absorption. In the case that the collision energy is large and the energy generated by the collision cannot be completely absorbed by the energy absorption structure of the coupler 11, the fasteners between the coupler mounting base 12 and the traction beams 22 and the fasteners between the coupler mounting base 12 and the plate bodies 21*a* are subjected to force and absorb energy. When the energy generated by the collision reaches a certain value, it may cut off the fasteners, and a secondary energy absorption is performed by cutting off the fasteners. At this time, the fixation constraint among the coupler mounting base 12, the traction beams 22 and the plate bodies 21*a* is released, and since the sliding components 121 fixed to the coupler mounting base 12 can slidably cooperate with the guiding slide ways 211 of the plate bodies 21*a* respectively, the sliding components 121 at this time will drive the coupler mounting base 12 and the coupler 11 to slide along the guiding slide ways 211 towards the rear lower side of the vehicle body, to perform energy absorption by sliding. Moreover, since the guiding slide ways 211 limit the motion paths of the coupler 11 and the coupler mounting base 12, it can prevent the coupler 11 and the coupler mounting base 12 from intruding an upper part above the traction beams 22 and damaging the devices in the upper part or from falling onto the rail in the sliding process. As shown in FIG. 5, FIG. 5 is a schematic view showing the structure of the coupler 11 and the coupler mounting base 12 after sliding along the guiding slide ways 211 after the collision.

It is to be noted that since the couplers 11 of the two vehicles are coupled, the couplers 11 can be kept in the horizontal state all along in the sliding process.

It is also to be noted that, after the collision, when the coupler 11 and the coupler mounting base 12 are in the state shown in FIG. 5 and the energy generated by the collision is not yet completely absorbed, the coupler 11 will continue to move backward from the position shown in FIG. 5, however, the coupler 11 at this time has already avoided the equipment compartment, thus the continued backward moving of the coupler 11 will not cause damages to the equipment in the equipment compartment.

Therefore, the order of energy absorption in collision of the rail vehicle equipped with the coupler assembly is: the coupler 11 itself→the fasteners between the coupler mounting base 12 and the traction beams 22 and the fasteners between the coupler mounting base 12 and the plate bodies 21*a*→the guiding slide ways 211→the vehicle body.

It is further to be emphasized that the arrangement and the number of the fasteners between the coupler mounting base 12 and the traction beams 22 and the fasteners between the coupler mounting base 12 and the plate bodies 21*a* are determined after verification in accordance with the practical requirements, and should ensure that the fasteners will not be cut off when the coupler 11 is in normal coupled operation or subjected to a longitudinal impact, or encounters small collisions.

Figure 6:
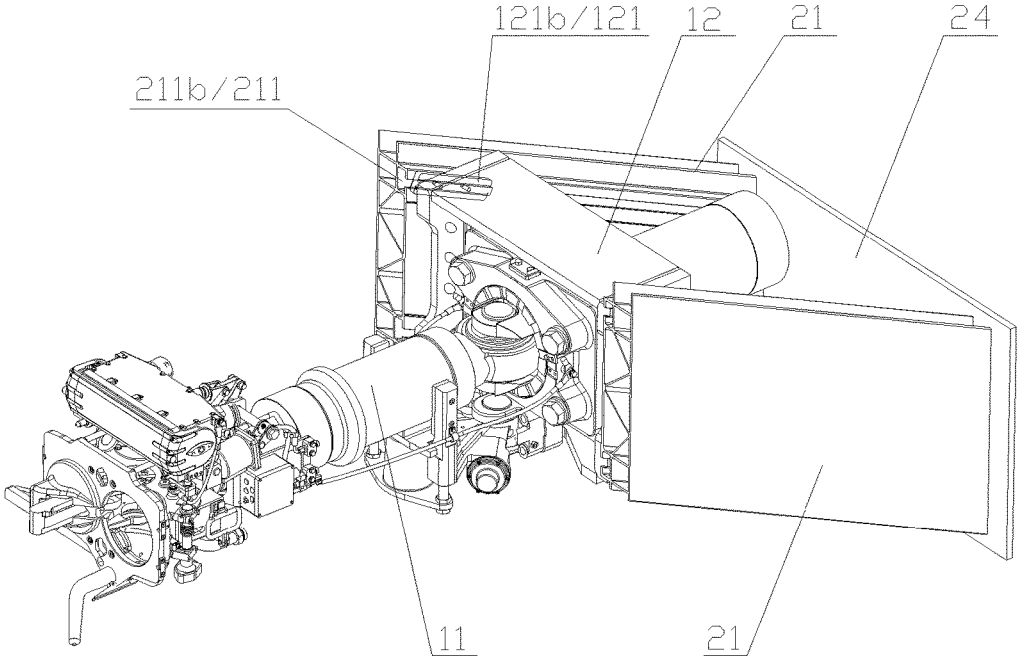
FIG. 6 is a schematic view showing the structure of a second embodiment of a coupler assembly according to the present application.
Figure 7:
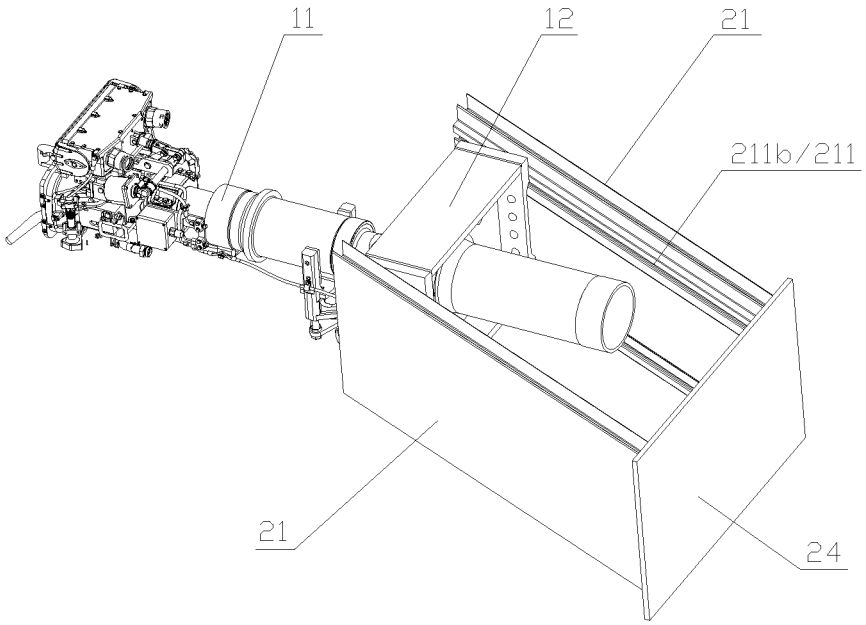
FIG. 7 is a schematic view showing the structure of the coupler assembly in FIG. 6 viewed from another angle.
Figure 8:
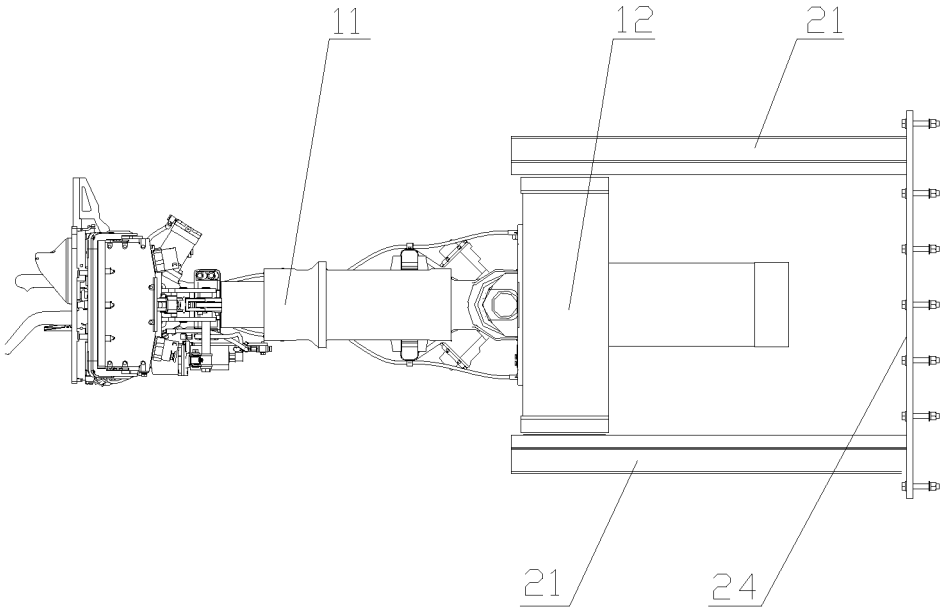
FIG. 8 is a top view of the coupler assembly in FIG. 6.
Figure 9:
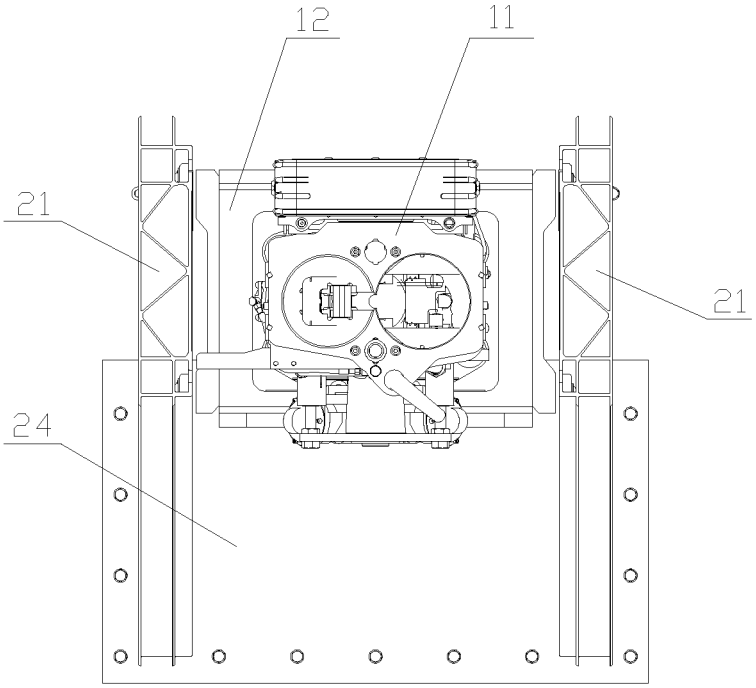
FIG. 9 is a side view of the coupler assembly in FIG. 6.

Referring to FIGS. 6 to 9, FIG. 6 is a schematic view showing the structure of a second embodiment of a coupler assembly according to the present application; FIG. 7 is a schematic view showing the structure of the coupler assembly in FIG. 6 viewed from another angle; FIG. 8 is a top view of the coupler assembly in FIG. 6; and FIG. 9 is a side view of the coupler assembly in FIG. 6.

In this embodiment, the coupler assembly includes a coupler 11 and a coupler mounting base 12. The coupler 11 is fixedly mounted to the coupler mounting base 12.

In this embodiment, the coupler assembly further includes a supporting component 21 arranged on each of two sides of the coupler mounting base 12, and each of the supporting components 21 is provided with a guiding slide way 211. The supporting components 21 are fixedly connected to the vehicle head.

It is to be noted that two sides of the coupler mounting base 12 herein refer to two sides in a transverse direction of the rail vehicle.

The guiding slide way 211 of the supporting component 21 is inclined in a longitudinal direction and has a front end higher than a rear end thereof, that is, the guiding slide way 211 is arranged to be inclined towards a rear lower side of a vehicle body, and the longitudinal direction here refers to a length direction of the rail vehicle.

A sliding component 121 is fixedly arranged at each of the two sides of the coupler mounting base 12, and the sliding component 121 slidably cooperates with the guiding slide way 211 of the supporting component 21 at the respective side.

In this solution, the guiding slide way 211 is specifically configured as a guiding slide slot 211*b* formed in the supporting component 21, and the sliding component 121 is specifically configured as a sliding block 121*b*.

The coupler assembly is specifically configured such that in an initial state, that is, after the coupler assembly and the vehicle head are initially assembled, the coupler mounting base 12 is fixedly connected to all the supporting components 21, and each of the sliding blocks 121*b* is located at a front end of the respective guiding slide slot 211*b* cooperating with the sliding block 121*b*.

It is to be emphasized here that, the cooperation between the sliding block 121*b* and the guiding slide slot 211*b* is specifically configured such that when the relative fixed state between the coupler mounting base 12 and the supporting components 21 is released, the sliding blocks 121*b* can drive the coupler mounting base 12 and the coupler 11 to slide together along the guiding slide slots 211*b* respectively.

As described above, the supporting components 21 are fixedly provided at the two sides of the coupler mounting base 12 of the coupler assembly respectively, the supporting component 21 has the guiding slide slot 211*b*, and the guiding slide slot 211*b* is inclined in the longitudinal direction of the vehicle body, and has a front end higher than a rear end thereof, and the sliding blocks 121*b* slidably cooperating with the guiding slide slots 211*b* at the respective sides are fixedly arranged at the two sides of the coupler mounting base 12. In practice, when the rail vehicle collides, the fixed state between the coupler mounting base 12, to which the coupler 11 is fixedly mounted, and the supporting components 21 is released, and since the sliding blocks 121*b* of the coupler mounting base 12 can slidably cooperate with the guiding slide slots 211*b* respectively, at this time the coupler mounting base 12 can slide together with the sliding blocks 121*b* along the guiding slide slots 211*b* respectively towards the rear lower side of the vehicle body, that is, the motion path of the coupler mounting base 12 after being collided is limited, thus preventing the coupler mounting base 12 from intruding an upper part above the supporting components 21 and damaging the devices in the upper part accordingly or from falling onto the rail and increasing the risk of derailment accordingly, and thereby in turn improving the passive safety of the rail vehicle in collision.

It is to be noted here that the couplers 11 of two vehicles are coupled during the collision, therefore, the coupler 11 and the coupler mounting base 12 can be kept in a horizontal state while sliding along the guiding slide slots 211*b*.

In a solution, the coupler assembly further includes a mounting plate 24, the mounting plate 24 is fixedly connected to rear ends of the two supporting components 21 and is configured to be connected to the vehicle head of the rail vehicle.

Specifically, the mounting plate 24 may be fixed to the supporting components 21 by welding, which is convenient and reliable. Of course, they may be fixed in other fixing manners.

In a solution, each of the supporting components 21 is provided with two or more guiding slide slots 211*b*, and apparently, the guiding slide slots 211*b* are in parallel with each other.

Preferably, the guiding slide slots 211*b* of the supporting component 21 are arranged uniformly, which can allow the coupler mounting base 12 to slide along the guiding slide slots 211*b* relatively smoothly after the collision.

Apparently, the number of the sliding blocks 121*b* at each side of the coupler mounting base 12 is identical with the number of the guiding slide slots 211*b* of the supporting component 21 at the corresponding side.

In a solution, the supporting component 21 is an extrudate structure. In this way, the supporting component 21 can have a high strength and flexibility, and can improve the passive safety of the coupler assembly.

In a solution, the two sides of the coupler mounting base 12 are fixedly connected to the supporting components 21 by fasteners. More specifically, the fasteners may be rivets, bolts, cotter pins, or the like. In this way, the coupler mounting base 12 fixedly connected to the supporting components 21 is detachable, thus facilitating the maintenance.

In a solution, the coupler 11 is configured as a coupler having an energy absorbing structure, and in this way, when the rail vehicle is in collision, the coupler 11 can absorb the energy generated by the collision to a certain extent, thereby further improving the passive safety of the vehicle in collision.

Figure 10:
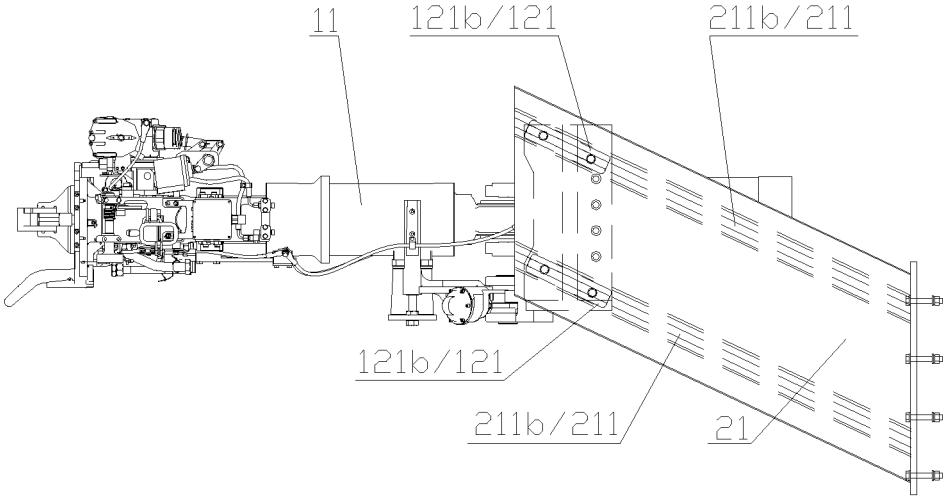
FIG. 10 is a schematic view showing the structure of the coupler assembly in FIG. 6 and a front end of a vehicle head before collision.
Figure 11:
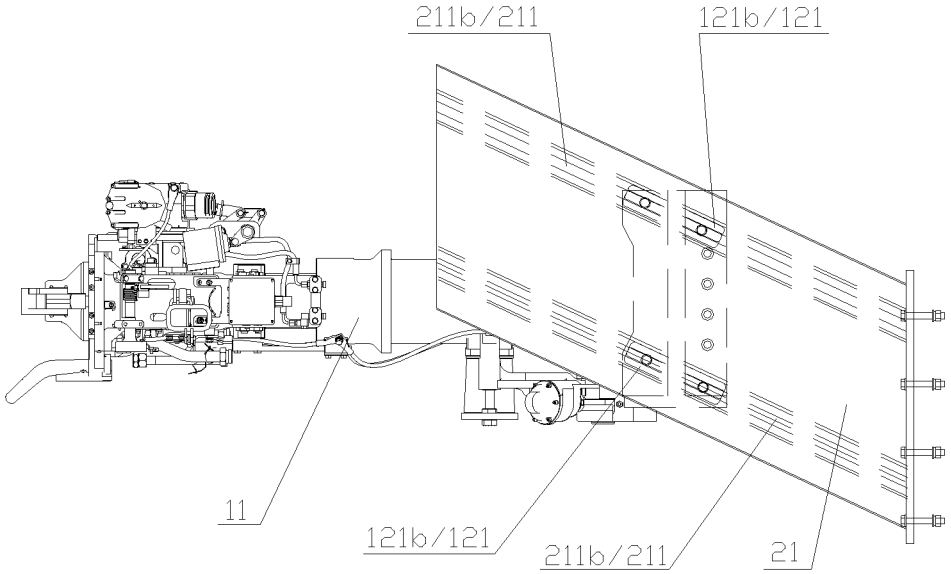
FIG. 11 is a schematic view showing the structure of the coupler assembly in FIG. 6 and the front end of the vehicle head after the collision.

Reference is made to FIGS. 10 and 11, FIG. 10 is a schematic view showing the structure of the coupler assembly in FIG. 6 and a front end of a vehicle head before collision; and FIG. 11 is a schematic view showing the structure of the coupler assembly in FIG. 6 and the front end of the vehicle head after the collision.

In the solution shown in FIGS. 10 and 11, the supporting component 21 has two guiding slide slots 211*b*. It may be appreciated that, in practical configuration, the number of the guiding slide slots 211*b* is not limited to this.

As shown in FIG. 10, in the initially assembled state, the coupler mounting base 12 and the supporting components 21 of the coupler assembly are fixedly connected by fasteners, and at this time, each of the sliding blocks 121*b* fixed to the coupler mounting base 12 is located at a front end of the guiding slide slot 211*b* of the respective supporting component 21.

When two rail vehicles collide, firstly, the couplers 11 of the two vehicles are coupled. Since the coupler 11 is an energy-absorbing coupler, its energy absorbing structure begins to perform primary energy absorption. In the case that the collision energy is large and the energy generated by the collision cannot be completely absorbed by the energy absorption structure of the coupler 11, the fasteners between the coupler mounting base 12 and the supporting components 21 are subjected to force and absorb energy. When the energy generated by the collision reaches a certain value, it may cut off the fasteners, and a secondary energy absorption is performed by cutting off the fasteners. At this time, the fixation constraint between the coupler mounting base 12 and the supporting components 21 is released, and since the sliding blocks 121*b* fixed to the coupler mounting base 12 can slidably cooperate with the guiding slide slots 211*b* of the supporting components 21 respectively, the sliding blocks 121*b* at this time will drive the coupler mounting base 12 and the coupler 11 to slide along the guiding slide slots 211*b* towards the rear lower side of the vehicle body to perform energy absorption by sliding. Moreover, since the guiding slide slots 211*b* limit the motion paths of the coupler 11 and the coupler mounting base 12, it can prevent the coupler 11 and the coupler mounting base 12 from colliding with the equipment compartment at the rear side during the sliding process. As shown in FIG. 11, FIG. 11 is a schematic view showing the structure of the coupler 11 and the coupler mounting base 12 after sliding along the guiding slide slots 211*b* after the collision.

It is to be noted that since the couplers 11 of the two vehicles are coupled, the couplers 11 can be kept in the horizontal state all along in the sliding process.

It is also to be noted that, after the collision, when the coupler 11 and the coupler mounting base 12 are in the state shown in FIG. 11 and the collision energy is not yet completely absorbed, the coupler 11 will collide the mounting plate 24 at the position where the coupler 11 is located after sliding and further collide the vehicle body, however, the coupler 11 at this time has already avoided the equipment compartment, thus the continued backward moving of the coupler 11 will not cause damages to the equipment in the equipment compartment.

Therefore, the order of energy absorption of the rail vehicle equipped with the coupler assembly in collision is: the coupler 11 itself→the fasteners between the coupler mounting base 12 and the supporting components 21→the supporting components 21→the mounting plate 24→the vehicle body.

It is also to be emphasized that the arrangement and the number of the fasteners between the coupler mounting base 12 and the supporting components 21 are determined after verification in accordance with the practical requirements, and should ensure that the fasteners will not be cut off when the coupler 11 is in normal coupled operation or subjected to a longitudinal impact, or encounters small collisions.

Figure 12:
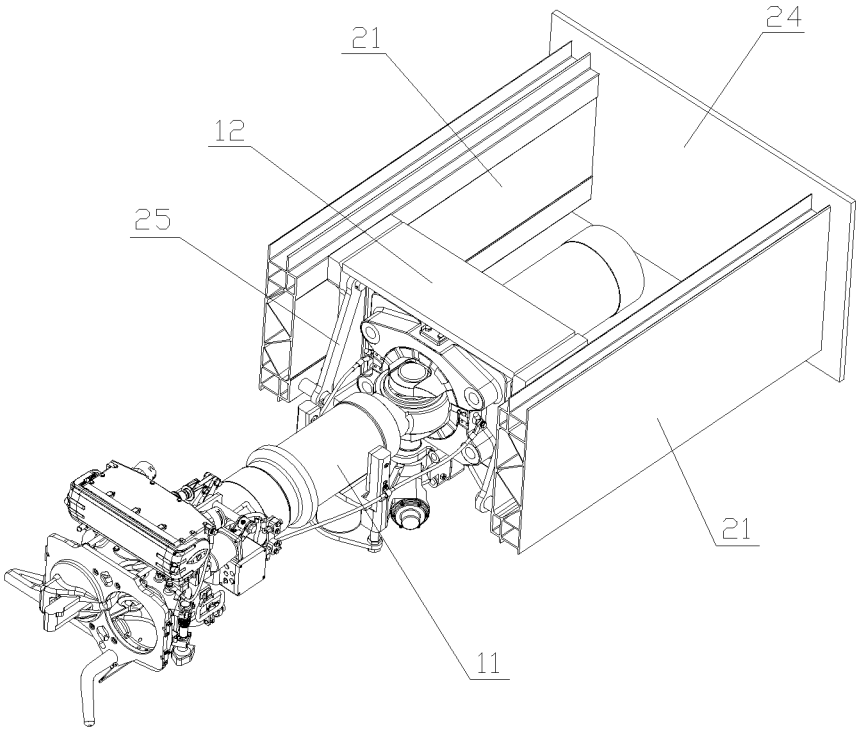
FIG. 12 is a schematic view showing the structure of a third embodiment of a coupler assembly according to the present application.
Figure 13:
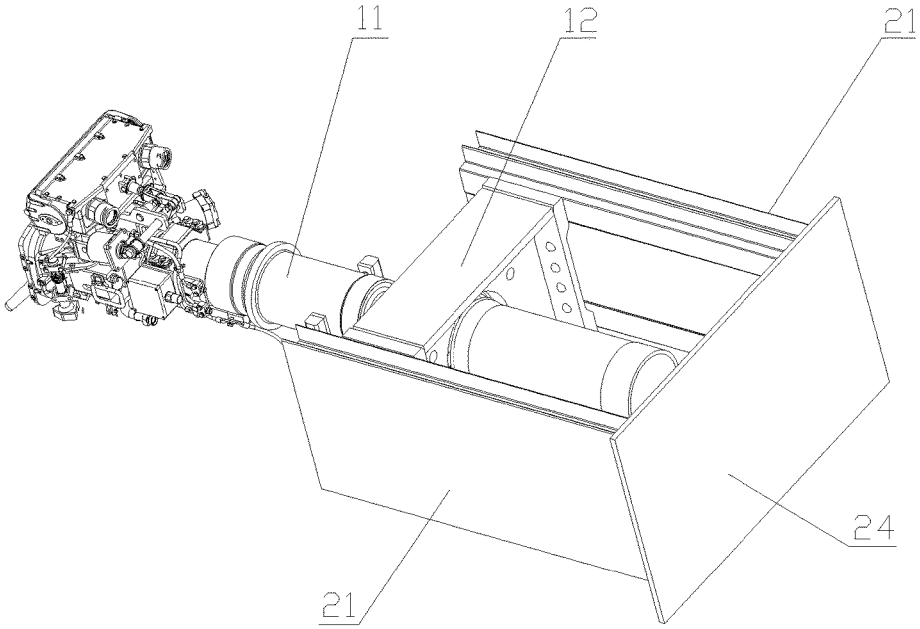
FIG. 13 is a schematic view showing the structure of the coupler assembly in FIG. 12 viewed from another angle.
Figure 14:
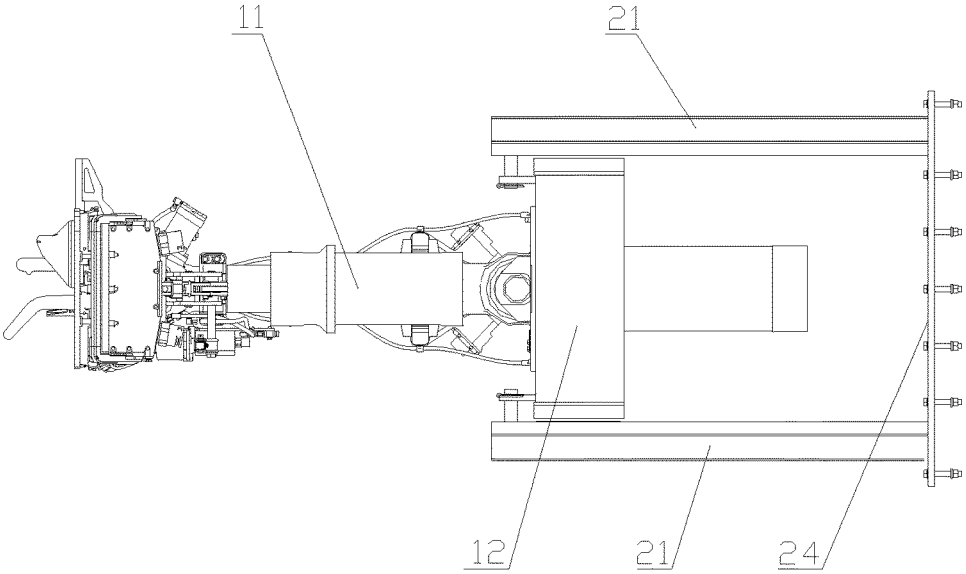
FIG. 14 is a top view of the coupler assembly in FIG. 12.
Figure 15:
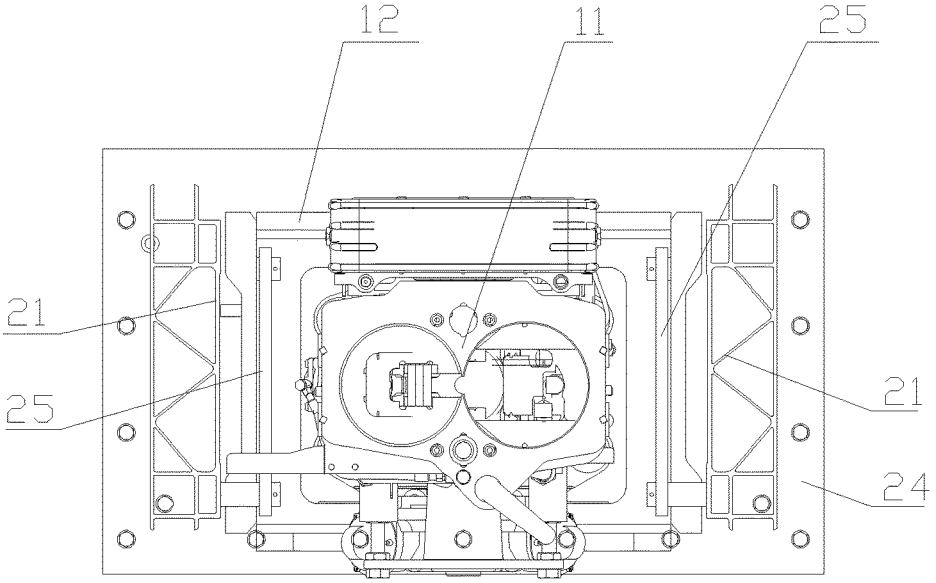
FIG. 15 is a side view of the coupler assembly in FIG. 12.

Referring to FIGS. 12 to 15, FIG. 12 is a schematic view showing the structure of a third embodiment of a coupler assembly according to the present application; FIG. 13 is a schematic view showing the structure of the coupler assembly in FIG. 12 viewed from another angle; FIG. 14 is a top view of the coupler assembly in FIG. 12; and FIG. 15 is a side view of the coupler assembly in FIG. 12.

In this embodiment, the coupler assembly includes a coupler 11 and a coupler mounting base 12. The coupler 11 is fixedly mounted to the coupler mounting base 12.

In this embodiment, the coupler assembly further includes a supporting component 21 and a rotating member 25 both arranged at each of two sides of the coupler mounting base 12. The supporting components 21 are fixedly connected to the vehicle head.

It is to be noted that two sides of the coupler mounting base 12 herein refer to two sides in a transverse direction of the rail vehicle.

The rotating member 25 has one end rotatably connected to a lower end of the respective supporting component 21, and the rotation center of this end is arranged horizontally and perpendicular to the length direction of the rail vehicle. The rotating member 25 has another end hinged to an upper end of the coupler mounting base 12.

The coupler assembly is specifically configured such that in an initial state, that is, after the coupler assembly and the vehicle head are initially assembled, the coupler mounting base 12 is fixedly connected to the supporting components 21, and a hinge point where the rotating member 25 is hinged to the coupler mounting base 12 is located above a rotational connection point where the rotating member 25 is rotatably connected to the respective supporting component 21.

It is to be emphasized here that when the relative fixed state between the coupler mounting base 12 and the supporting components 21 is released, the rotating members 25 can respectively rotate about the rotational connection points where the rotating members 25 are rotatably connected to the respective supporting components 21, and can meanwhile drive the coupler mounting base 12 to move. That is, when the coupler mounting base 12 and the supporting components 21 are in the fixed state, the rotation of the rotating members 25 is restricted.

As described above, the supporting components 21 and the rotating members 25 are provided at two sides of the coupler mounting base 12 of the coupler assembly, and each of the rotating members 25 has one end rotatably connected to a lower end of the respective supporting component 21 and another end hinged to an upper end of the coupler mounting base 12. The coupler assembly is configured such that in an initial state, the coupler mounting base 12 is fixedly connected to the supporting components 21, and the connection point where the rotating member 25 is connected to the coupler mounting base 12 is higher than the connection point where the rotating member 25 is connected to the respective supporting component 21. In practice, after the rail vehicle collides, the coupler mounting base 12, to which the coupler 11 is fixedly mounted, is collided to be broken, the fixing state between the coupler mounting base 12 and the supporting components 21 is released, and at this time, since the rotating members 25 are rotatably connected to the lower ends of the supporting components 21, the rotating members 25 rotate towards the rear side of the vehicle body due to the collision, and since the coupler mounting base 12 is hinged to the rotating members 25, the coupler 11 and the coupler mounting base 12 are driven by the rotation of the rotating members 25 to move along a circular-arc path to the rear lower side of the vehicle body. That is, the motion path of the coupler mounting base 12 after being collided is limited, thus preventing the coupler mounting base 12 from intruding into an upper part above the supporting components 21 and damaging the devices in the upper part accordingly or falling onto the rail and increasing the risk of derailment accordingly, and thereby in turn improving the passive safety of the rail vehicle in collision.

It is to be noted here that, the couplers 11 of two vehicles are coupled during the collision, therefore, the coupler 11 driven by the rotation of the rotating members 25 can be kept in a horizontal state all along.

In a solution, the coupler assembly further includes a mounting plate 24, the mounting plate 24 is fixedly connected to rear ends of the two supporting components 21 and is configured to be connected to the vehicle head of the rail vehicle.

Specifically, the mounting plate 24 may be fixed to the supporting components 21 by welding, which is convenient and reliable. Of course, they may be fixed in other fixing manners.

In a practical application, the supporting component 21 may be embodied as an extrudate structure. In this way, the supporting component 21 can have a high strength and flexibility, and can improve the passive safety of the coupler assembly. Of course, the supporting component 21 may also be embodied as other structures, and the rotating member 25 may be embodied as a beam structure.

In a solution, each of the rotating members 25 is hinged to the coupler mounting base 12 by a first rotating shaft, and is rotatably connected to the respective supporting component 21 by a second rotating shaft.

The first rotating shaft and the second rotating shaft may be fixed respectively to the coupler mounting base 12 and the respective supporting component 21 by fasteners. More specifically, the fasteners may be rivets, bolts, cotter pins or the like.

In an embodiment, two ends of the coupler mounting base 12 are fixedly connected to the supporting components 21 also by fasteners. Similarly, the fasteners may be structures such as a rivet or bolt or cotter pin.

In a solution, the coupler 11 is configured as a coupler having an energy absorbing structure, and in this way, when the rail vehicle is in collision, the coupler 11 can absorb the energy generated by the collision to a certain extent, thereby further improving the passive safety of the vehicle in collision.

Figure 16:
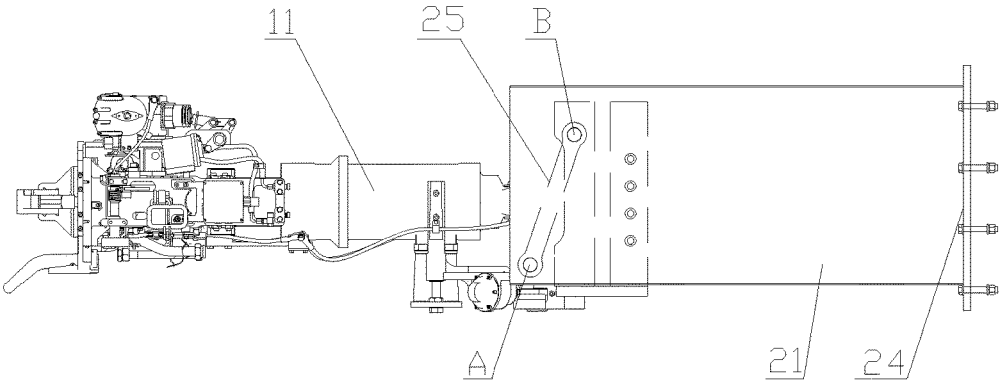
FIG. 16 is a schematic view showing the structure of the coupler assembly in FIG. 12 and a front end of a vehicle head before collision.
Figure 17:
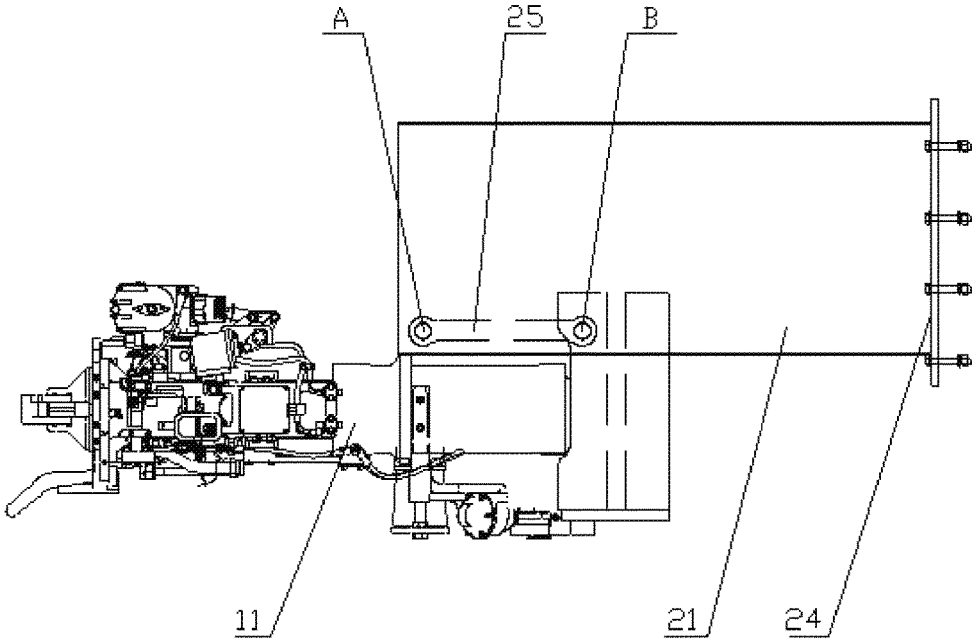
FIG. 17 is a schematic view showing the structure of the coupler assembly in FIG. 12 and the front end of the vehicle head after the collision.

Reference is made to FIGS. 16 and 17, FIG. 16 is a schematic view showing the structure of the coupler assembly in FIG. 12 and a front end of a vehicle head before collision; and FIG. 17 is a schematic view showing the structure of the coupler assembly in FIG. 12 and the front end of the vehicle head after the collision.

For facilitating the description, in FIGS. 16 and 17, a rotational connection point where the rotating member 25 is rotatably connected to the respective supporting component 21 is marked as A, and the hinge point where the rotating member 25 is hinged to the coupler mounting base 12 is marked as B.

As shown in FIG. 16, in the initially assembled state, the coupler mounting base 12 and the supporting components 21 of the coupler assembly are fixedly connected by fasteners, and in this case, the hinge point B where the rotating member 25 is hinged to the coupler mounting base 12 is located above the rotational connection point A where the rotating member 25 is rotatably connected to the respective supporting component 21.

In this state, since the coupler mounting base 12 is fixedly connected to the supporting component 21, the rotation of the rotating member 25 is restricted.

When two rail vehicles collide, firstly, the couplers 11 of the two vehicles are coupled. Since the coupler 11 is an energy-absorbing coupler, its energy absorbing structure begins to perform primary energy absorption. In the case that the collision energy is large and the energy generated by the collision cannot be completely absorbed by the energy absorption structure of the coupler 11, the fasteners between the coupler mounting base 12 and the supporting components 21 are subjected to force and absorb energy. When the energy generated by the collision reaches a certain value, it may cut off the fasteners, and a secondary energy absorption is performed by cutting off the fasteners. At this time, the fixation constraint between the coupler mounting base 12 and the supporting components 21 is released—the restriction to the rotation of each of the rotating members 25 is released, and under the action of the energy generated by the collision, the rotating member 25 can rotate about the point A towards the rear side of the vehicle body. In the examples shown in FIGS. 16 and 17, the rotating member 25 rotates clockwise about the point A, and since the coupler mounting base 12 is hinged to the rotating members 25, and also since the couplers 11 of the two vehicles are coupled, at this time the coupler mounting base 12 driven by the rotating members 25 can be kept in a horizontal state and moves along the circular arc-shaped path towards the rear lower side of the vehicle body, to avoid the equipment compartment. As shown in FIG. 17, FIG. 17 is a schematic view showing the structure of the coupler 11 and the coupler mounting base 12 after moving along the circular arc-shaped path towards the rear lower side of the vehicle body after the collision.

It is to be noted that, after the collision, when the coupler 11 and the coupler mounting base 12 are in the state shown in FIG. 17 and if the collision energy is not yet completely absorbed, the coupler 11 will collide the mounting plate 24 and further the vehicle body at the position where the coupler 11 is located after sliding down, however, the coupler 11 at this time has already avoided the equipment compartment, thus the continued backward moving of the coupler 11 will not cause damages to the equipment in the equipment compartment.

Therefore, the order of energy absorption of the rail vehicle equipped with the coupler assembly in collision is: the coupler 11 itself→the fasteners between the coupler mounting base 12 and the supporting components 21→the rotating members 25→the mounting plate 24→the vehicle body.

It is also to be emphasized that the arrangement and the number of the fasteners between the coupler mounting base 12 and the supporting components 21 are determined after verification in accordance with the practical requirements, and should ensure that the fasteners will not be cut off when the coupler 11 is in normal coupled operation or subjected to a longitudinal impact, or encounters small collisions.

In addition to the above coupler assembly, a rail vehicle is further provided according to the present application, which includes a vehicle head and a coupler assembly arranged at a front end of the vehicle head, and the coupler assembly is the coupler assembly according to any one of the above embodiments.

Since the above coupler assembly has the above technical effects, the rail vehicle having the coupler assembly also has corresponding technical effects, which will not be repeated here.

It is to be noted that, the main body part of the rail vehicle is not a key point of the present application and may be implemented according to the conventional technology, which will not be repeated here.

The coupler assembly and the rail vehicle having the coupler assembly according to the present application are described in detail hereinbefore. The principle and the embodiments of the present application are illustrated herein by specific examples. The above description of examples is only intended to help the understanding of the method and idea of the present application. It should be noted that, for the person skilled in the art, a few of modifications and improvements may be made to the present application without departing from the principle of the present application, and these modifications and improvements are also deemed to fall into the scope of protection of the present application defined by the claims.

The invention claimed is:

1. A coupler assembly, configured to be arranged at a front end of a vehicle head of a rail vehicle, the coupler assembly comprising:

a coupler mounting base; and a coupler fixedly mounted to the coupler mounting base, wherein the coupler assembly further comprises a supporting component provided at each of two sides of the coupler mounting base, the supporting component has a guiding slide way inclined longitudinally, and a front end of the guiding slide way is higher than a rear end of the guiding slide way; and the supporting component is fixed to the vehicle head; and a sliding component is fixedly provided at each of the two sides of the coupler mounting base, and the sliding component slidably cooperates with the guiding slide way at a respective side; and the coupler assembly is configured such that in an initial state, the coupler mounting base is fixedly connected to the supporting component, and the sliding component is located at a front end of the guiding slide way.

2. The coupler assembly according to claim 1, wherein the supporting component is a plate body fixed to a bottom of a traction beam of the vehicle head.

3. The coupler assembly according to claim 2, further comprising a stop plate fixed to the traction beam, wherein, the stop plate is located above the coupler mounting base.

4. The coupler assembly according to claim 2, wherein the guiding slide way is a slide hole formed in the plate body, and the sliding component is a pin; or, the guiding slide way is a slide slot formed in the plate body, and the sliding component is a pulley.

5. The coupler assembly according to claim 1, wherein the guiding slide way is a guiding slide slot formed in the supporting component, and the sliding component is a sliding block.

6. The coupler assembly according to claim 5, further comprising a mounting plate configured to be connected to the vehicle head, wherein the mounting plate is fixedly connected to rear ends of two of the supporting components.

7. The coupler assembly according to claim 5, wherein the supporting component is an extrudate structure.

8. A coupler assembly, configured to be arranged at a front end of a vehicle head of a rail vehicle, the coupler assembly comprising:

a coupler mounting base fixed to the vehicle head; and a coupler fixedly mounted to the coupler mounting base, wherein the coupler assembly further comprises a supporting component and a rotating member both provided at each of two sides of the coupler mounting base;

the rotating member has one end rotatably connected to a lower end of the supporting component, and a rotation center of this end is arranged horizontally and perpendicular to a length direction of the rail vehicle, and the rotating member has another end hinged to an upper end of the coupler mounting base; and the coupler assembly is configured such that in an initial state, the coupler mounting base is fixedly connected to the supporting component, and a hinge point where the rotating member is hinged to the coupler mounting base is located above a rotational connection point where the rotating member is rotatably connected to the respective supporting component.

9. The coupler assembly according to claim 8, wherein the rotating member is hinged to the coupler mounting base by a first rotating shaft, and the rotating member is rotatably connected to the respective supporting component by a second rotating shaft.

10. The coupler assembly according to claim 9, wherein the first rotating shaft and the second rotating shaft are respectively fixed to the coupler mounting base and the respective supporting component by fasteners.

11. The coupler assembly according to claim 9, further comprising a mounting plate configured to be connected to the vehicle head, wherein the mounting plate is fixedly connected to rear ends of two of the supporting components.

12. The coupler assembly according to claim 9, wherein the supporting component is an extrudate structure.

13. The coupler assembly according to claim 1, further comprising a mounting plate configured to be connected to the vehicle head, wherein the mounting plate is fixedly connected to rear ends of two of the supporting components.

14. The coupler assembly according to claim 1, wherein the supporting component is an extrudate structure.

15. The coupler assembly according to claim 1, wherein the coupler is a coupler having an energy absorbing structure.

16. A rail vehicle, comprising a vehicle head and a coupler assembly provided at a front end of the vehicle head, wherein the coupler assembly is the coupler assembly according to claim 1.

17. The coupler assembly according to claim 8, further comprising a mounting plate configured to be connected to the vehicle head, wherein the mounting plate is fixedly connected to rear ends of two of the supporting components.

18. The coupler assembly according to claim 8, wherein the supporting component is an extrudate structure.

19. The coupler assembly according to claim 8, wherein the coupler is a coupler having an energy absorbing structure.

20. A rail vehicle, comprising a vehicle head and a coupler assembly provided at a front end of the vehicle head, wherein the coupler assembly is the coupler assembly according to claim 8.

* * * * *